US012708975B2

(12) United States Patent
Abdi et al.

(10) Patent No.: US 12,708,975 B2
(45) Date of Patent: Aug. 18, 2026

(54) METHOD AND ASSEMBLY FOR SLURRY DELIVERY AND UTILIZATION DURING ULTRASONIC IMPACT GRINDING

(71) Applicant: RTX Corporation, Farmington, CT (US)

(72) Inventors: Ahmed Abdillahi Abdi, Oceanside, CA (US); Andrew Joseph Lazur, La Jolla, CA (US)

(73) Assignee: RTX Corporation, Farmington, CT (US)

( * ) Notice: Subject to any disclaimer, the term of this patent is extended or adjusted under 35 U.S.C. 154(b) by 388 days.

(21) Appl. No.: 18/232,071

(22) Filed: Aug. 9, 2023

(65) Prior Publication Data

US 2025/0050467 A1 Feb. 13, 2025

(51) Int. Cl.

| | |
|---|---|
| ***B24B 1/04*** | (2006.01) |
| ***B24B 31/00*** | (2006.01) |
| ***B24B 31/023*** | (2006.01) |
| ***B24B 31/06*** | (2006.01) |

(52) U.S. Cl.

CPC ..... *B24B 1/04* (2013.01); *B24B 31/023* (2013.01); *B24B 31/003* (2013.01); *B24B 31/064* (2013.01)

(58) Field of Classification Search

CPC ... B24B 31/003; B24B 31/02; B24B 31/0224; B24B 31/023; B24B 31/06; B24B 31/064; B24B 31/12; B24B 1/04

See application file for complete search history.

(56) References Cited

U.S. PATENT DOCUMENTS

| | | | | |
|---|---|---|---|---|
| 4,100,701 | A | 7/1978 | Bessaguet | |
| 5,384,989 | A * | 1/1995 | Shibano | B24B 1/04 451/36 |
| 2011/0278231 | A1* | 11/2011 | Nishijima | B24B 1/04 210/695 |
| 2017/0087687 | A1* | 3/2017 | Kamireddi | B24B 37/042 |
| 2020/0122296 | A1 | 4/2020 | Morancais et al. | |
| 2021/0339357 | A1 | 11/2021 | Lian et al. | |
| 2023/0294236 | A1* | 9/2023 | Gopinath | B24B 49/00 451/32 |

FOREIGN PATENT DOCUMENTS

| | | | | |
|---|---|---|---|---|
| CN | 108581816 | A * | 9/2018 | B24B 31/116 |
| CN | 109623510 | A * | 4/2019 | B24B 1/04 |

(Continued)

OTHER PUBLICATIONS

Xiu, CN-109623510-A machine translation, Apr. 16, 2019 (Year: 2019).*

(Continued)

*Primary Examiner* — Brian D Keller
*Assistant Examiner* — Marcel T Dion
(74) *Attorney, Agent, or Firm* — Kinney & Lange, P.A.

(57) ABSTRACT

An ultrasonic impact grinding assembly includes a vessel having an open top disposed opposite a base and configured to contain an abrasive slurry, at least one mixing mechanism disposed in the vessel, a fixture disposed on the base of the vessel and configured to retain a workpiece for ultrasonic impact grinding within the abrasive slurry, and an ultrasonic impact grinding machine having a tool tip disposed to contact the abrasive slurry in the vessel during an ultrasonic impact grinding operation.

17 Claims, 3 Drawing Sheets

(56) References Cited

FOREIGN PATENT DOCUMENTS

| | | | | | |
|---|---|---|---|---|---|
| CN | 114055330 | A | * | 2/2022 | ..... B24B 31/027 |
| WO | 2010084635 | A1 | | 7/2010 | |

OTHER PUBLICATIONS

Zhang, CN-114055330-A machine translation, Feb. 18, 2022 (Year: 2022).*
Zhao, CN-108581816-A machine translation, Sep. 28, 2018 (Year: 2018).*
Extended European Search Report for EP Application No. 24192920.7, dated Jan. 24, 2025, 8 pages.

* cited by examiner

METHOD AND ASSEMBLY FOR SLURRY DELIVERY AND UTILIZATION DURING ULTRASONIC IMPACT GRINDING

BACKGROUND

The present disclosure relates generally to machining ceramic matrix composites (CMCs) and, more particularly, to ultrasonic impact grinding (UIG).

Lightweight ceramic matrix composites (CMC) are highly desirable materials for gas turbine engine applications. CMCs, and particularly SiC/SiC CMCs (having silicon carbide matrix and fibers) exhibit excellent physical, chemical, and mechanical properties at high temperatures, making them particularly desirable for producing hot section components, including blade outer air seals (BOAS), vanes, blades, combustors, and exhaust structures. Like components made from other materials, it can be critical to the performance, durability, and function of the CMC component to cool the CMC component to maintain appropriate operating temperatures. Features for mitigating thermal stresses can include cooling channels provided through the material. There have been challenges in developing an efficient and cost-effective way to machine CMCs with high quality. SiC/SiC CMCs have a hardness second only to that of diamond and the SiC fiber reinforced phase results in anisotropy and heterogeneity.

UIG has been used to fabricate complex hole shapes with high aspect ratios on hard and brittle materials, such as CMCs. In UIG, electrical energy input to a transducer is converted to mechanical vibrations along a longitudinal axis at high frequency (usually at 20-40 kHz). The excited vibration is subsequently transmitted through an energy-focusing horn to amplify the vibration amplitude which is delivered to a tool tip. Thus, the tool, which locates directly above a workpiece, can vibrate along its longitudinal axis with a desired amplitude. An abrasive slurry comprising a mixture of abrasive material (e.g., diamond, boron carbide, etc.) suspended in water or oil is provided constantly into the machining area. The vibration of the tool causes the abrasive particles held in the slurry between the tool and the workpiece to impact the workpiece surface causing material removal by microchipping. Delivery of a continuous stream of abrasive slurry with sufficient and uniform flow between the ultrasonic tool and the workpiece is necessary for consistent machining. Challenges exist in providing sufficient and consistent delivery of abrasive slurry when machining features on a workpiece that requires 5-axis machining or orienting the tool tip at different angles relative to the workpiece surface. Abrasive slurry nozzles must be positioned in close proximity to the workpiece and tool tip to ensure delivery at the point of machining. Oftentimes, the workpiece must be repositioned to locate the machining surface below the tool tip to allow the abrasive slurry to pool at the point of machining. During the machining operation, the abrasive slurry is collected, filtered, mixed, and delivered back to the machining surface of the workpiece through the slurry nozzle.

While the UIG process has matured to offer true three-dimensional machining capability, improvements in the delivery of abrasive slurry are needed.

SUMMARY

An ultrasonic impact grinding assembly includes a vessel configured to contain an abrasive slurry, at least one mixing mechanism disposed in the vessel, the at least one mixing mechanism configured to agitate the abrasive slurry, a fixture disposed on a base of the vessel, and an ultrasonic impact grinding machine having a tool tip disposed to contact the abrasive slurry in the vessel during an ultrasonic grinding operation. The vessel is open at a top. The fixture is configured to retain a workpiece for ultrasonic impact grinding within the abrasive slurry.

A method for machining a ceramic workpiece includes submerging a machining surface of the ceramic workpiece in an abrasive slurry, positioning a tip of an ultrasonic impact grinding machine in proximity with the machining surface and into contact with the abrasive slurry, applying ultrasonic vibration to the tip, and agitating the abrasive slurry with a mixing mechanism disposed in the abrasive slurry.

The present summary is provided only by way of example, and not limitation. Other aspects of the present disclosure will be appreciated in view of the entirety of the present disclosure, including the entire text, claims and accompanying figures.

Figure 1:
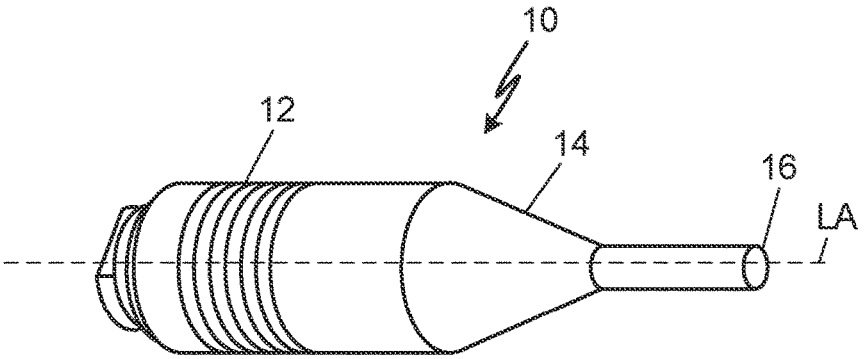
FIG. 1 is a side view of an ultrasonic impact grinding (UIG) sonotrode.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

The present disclosure provides an improved method and assembly for abrasive slurry delivery and utilization during ultrasonic impact grinding (UIG) processes, which can allow for efficient and consistent machining regardless of the orientation of a UIG tool tip and machining surface of a workpiece. As disclosed herein, the machining surface of the workpiece is submerged in an abrasive slurry bath during the UIG operation. Use of the abrasive slurry bath eliminates the need to deliver the abrasive slurry to the machining surface through a delivery nozzle and reduces the need to reposition the workpiece to maintain a sufficient flow of abrasive particles between the UIG tool tip and the machining surface. The disclosed UIG apparatus allows multiple machining surfaces to be simultaneously submerged and covered by abrasive particles.

FIG. 1 is a side view of a UIG sonotrode 10 configured to vibrate along longitudinal axis LA during a UIG operation to remove material from a workpiece. Sonotrode 10 includes transducer 12, horn 14, and tool tip 16. Horn 14 is disposed between transducer 12 and tool tip 16. Electrical energy is input to transducer 12, which is converted to mechanical vibrations along longitudinal axis LA at high frequency (usually 20-40 Hz). Transducer 12 may include one or more piezoelectric elements that, when activated with electric current, produce vibrational waves that propagate axially along longitudinal axis LA. When energized, transducer 12 transmits vibrational energy to tool tip 16 via horn 14. Horn 14 is mechanically coupled to transducer 12. Horn 14 can include multiple sections. Horn 14 has a converging portion configured to amplify a vibration amplitude delivered to tool tip 16. Horn can include features such as helical slots (not shown) to convert a portion of axial vibration to torsional vibration, while limiting excitation of undesirable bending modes. Tool tip 16 is disposed at a distal end of sonotrode 10. Tool tip 16 is configured to impart vibrational energy to an abrasive slurry between tool tip 16 and the machining surface of the workpiece as further described herein. Tool tip can be shaped to form a feature of desired geometry in the workpiece (e.g., a hole having a tapered cross-section). In some embodiments, sonotrode 10 can include a tool having multiple tips to form multiple features in the workpiece simultaneously. Sonotrode 10 is one example of a sonotrode and tool tip for use in the disclosed UIG apparatus. As will be understood by one of ordinary skill in the art, the disclosed UIG assembly is not limited to use with sonotrode 10.

Figure 2:
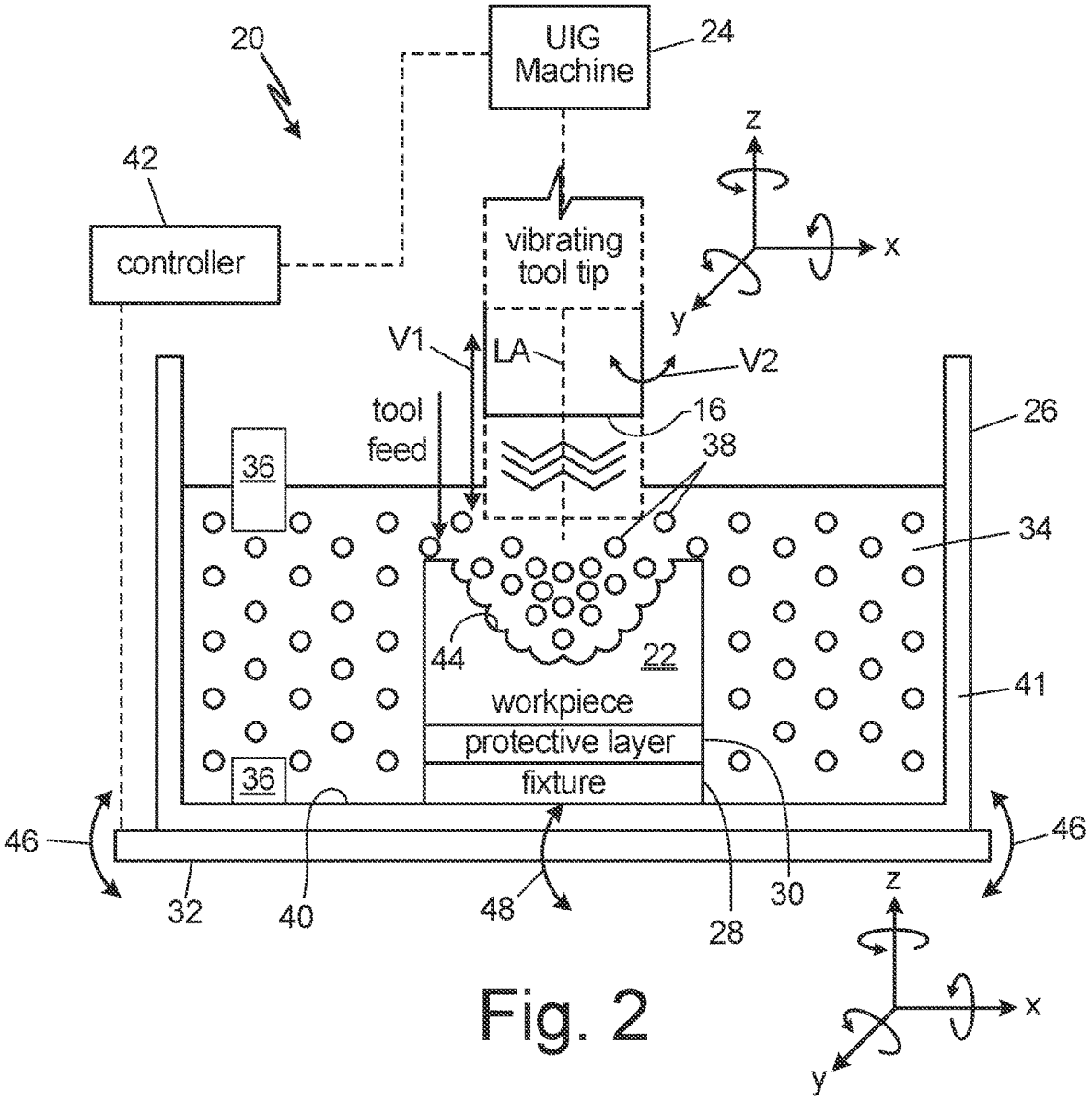
FIG. 2 is schematic view of a UIG assembly for machining workpiece.

FIG. 2 is schematic view of UIG assembly 20 for machining workpiece 22. As shown in FIG. 2, UIG assembly 20 includes UIG machine 24, vessel 26, fixture 28, protective layer 30, actuating platform 32, abrasive slurry 34, and mixing mechanism 36. Abrasive slurry 34 includes abrasive particles 38. Vessel 26 includes base 40 and side wall(s) 41. UIG machine 24 includes sonotrode 10 (not shown) of FIG. 1 having tool tip 16. UIG machine 24 can include, among other features not shown, an electric power source and actuating assembly configured to position tool tip 16 in varying locations along a surface of workpiece 22. The actuating assembly can include, for example, a robotic arm or other mechanical linkages configured to provide 3-, 5-, or 7-axis machining. UIG assembly 10 can include controller 42, such as a central processing unit of a computer, to coordinate movement of tool tip 16 relative to workpiece 22 and to coordinate movement of actuating platform 32 relative to tool tip 16.

Vessel 26 is configured to contain abrasive slurry 34 and workpiece 22. Vessel 26 is configured to provide an abrasive slurry bath for workpiece 22 such that a machining surface 44 of workpiece 22 is submerged during operation of UIG machine 24. Vessel 26 can include base 40 disposed on actuating platform 32. Vessel 26 can be affixed to actuating platform 32 to limit movement of vessel 26 relative to actuating platform 32. In some embodiments, actuating platform 32 can form base 40 of vessel 26. Vessel 26 is open at a top disposed opposite base 40 to provide UIG machine 24 with access to a top surface of workpiece 22. Vessel 26 can be sized to allow movement of tool tip 16 relative to workpiece 22 in vessel 26. Wall(s) 41 of vessel 26 can be spaced from workpiece 22 to allow UIG machine 24 to position tool tip 16 along side walls of workpiece 22. Vessel 26 can have any suitable shape (e.g., cylindrical, rectangular, etc.). Vessel 26 can have a depth suitable for submerging workpiece 22 in abrasive slurry 34 and allowing left, right, forward, back, and angled translation of tool tip 16, while containing abrasive slurry during operation. Vessel wall(s) 41 can be configured to keep machining surfaces 44 of workpiece 22 submerged during actuation of actuating platform 32. Vessel 26 can be sized to contain a plurality of workpieces. For example, in some embodiments, vessel 26 can be configured to contain multiple workpieces 22 disposed in a side-by-side arrangement. In some embodiments, UIG assembly 20 can be configured to machine multiple workpieces simultaneously with a plurality UIG sonotrodes 10 (FIG. 1). Vessel 26 can be formed of any suitable material for long-term containment of abradable slurry 34.

Fixture 28 is affixed to vessel 26. Fixture 28 can be disposed on and affixed to base 40 and/or side wall(s) 41 of vessel 26. Fixture 28 is configured to retain workpiece 22 in vessel 26 and to prevent movement of workpiece 22 relative to vessel 26 during UIG operation and upon actuation of actuating platform 32 and tool tip 16. Fixture 28 can secure workpiece 22 to allow six degrees of freedom of movement of workpiece 22 with actuating platform 32. Fixture 28 can include a plurality of cylindrical dowel pins and/or rectangular pads and retention mechanisms as described further herein to limit movement of workpiece 22 in all directions. Fixture 28 can be configured to retain workpiece 22 while exposing a plurality of machining surfaces 44.

Protective layer 30 is disposed on portions of fixture 28 configured to contact workpiece 22. In some embodiments, protective layer 30 can cover all exposed surfaces of fixture 28. Ultrasonic vibrations carried through workpiece 22 can cause wear at the workpiece/fixture interface. Protective layer 30 is configured to absorb vibrations carried through workpiece 22 (e.g., provide a cushioning effect) to prevent wear of fixture 28 by workpiece 22. Protective layer 30 can additionally protect workpiece 22 and fixture 28 from damage by abrasive particles 38. Protective layer 30 can be a sacrificial or replaceable film barrier. Protective layer 30 can be any material suitable for protecting workpiece 22 and fixture 28 and preventing abrasive particles 38 from lodging or moving between workpiece 22 and fixture 28 during UIG operation. Protective barrier 30 can be formed of a material capable of conforming to the surface of workpiece 22 and to the surface of fixture 28 to effectively seal an interface of workpiece 22 and fixture 28 from abrasive particles 38. Protective layer 30 can comprise a polymer. Protective layer 30 can be, for example, a reinforced rubber having aramid fiber to provide stiffness. Protective layer 30 can be applied to fixture 28 prior to UIG operation and can be removed and replaced following UIG operation or as needed.

Workpiece 22 can be formed of a monolithic ceramic, a ceramic matrix composite (CMC), or combinations thereof. Workpiece 22 can be, for example, a monolithic silicon carbide (SiC) or silicon nitride ($Si_3N_4$). In other embodiments, workpiece 22 can be, for example, a SiC/SiC CMC having silicon carbide fibers disposed in a silicon carbide matrix. Alternatively, the fibers and/or matrix may be $Si_3N_4$. While the disclosed UIG assembly is particularly suited for improving the efficiency and throughput of ceramic and/or CMC manufacturing, it is not limited to use on monolithic ceramic or CMC workpieces or to particular ceramic or CMC materials. Workpiece 22 can be a component of a gas turbine engine. For example, workpiece 22 can be a blade outer air seal, vane, blade, combustor, and/or exhaust structure configured for use at high temperatures.

Abrasive slurry 34 comprises a mixture of abrasive particles 38 suspended in water or oil. Abrasive particles 38 comprise a material capable of cutting into, abrading, or chipping away material from workpiece 22 when projected at machined surface 44 by ultrasonic vibration. The material of abrasive particle 38 can be selected based on the material of workpiece 22. Generally, abrasive particles 38 can have a hardness equal or greater than a hardness of the material of workpiece 22. Abrasive particles 38 can be, for example, diamond, boron carbide, or silicon carbide.

Abrasive slurry 34 can be supplied to vessel 26 after workpiece 22 has been secured to fixture 28. Abrasive slurry 34 can be provided to cover one or more machining surfaces 44 of workpiece 22. A height of abrasive slurry above one or more machining surfaces 44 can vary depending on the geometry of workpiece 22. UIG machine 24 is configured to place tool tip 16 into proximity with machining surface 44 without contacting machining surface 44 of workpiece 22. A level of abrasive slurry 34 in vessel 26 is set to maintain a constant layer of abrasive slurry 34 and, particularly, abrasive particles 38, between machining surface 44 and tool tip 16. The vibration of tool tip 16 causes abrasive particles 38 held in the slurry between tool tip 16 and workpiece 22 to impact machining surface 44 of workpiece 22 causing material removal by microchipping. Since actual machining is carried out by abrasive particles 38, tool tip 16 can be softer than workpiece 22. Tool tip 16 can be disposed a distance from machining surface 22 selected based on an axial displacement of tool tip 16 along longitudinal axis LA. The distance can be selected to limit or prevent direct contact between tool tip 16 and machining surface 44 during UIG operation.

Abrasive slurry 34 can be added or removed from vessel 26 to control a height of abrasive slurry 34 above machining surface 44. A height of abrasive slurry above machining surface 44 can impact machining efficiency as abrasive slurry 34 absorbs vibrational energy of tool tip 16. Tool tip 16 can be disposed in abrasive slurry 34 throughout UIG operation. The design of tool tip 16 and design and integration of the power supply for UIG machine 24 can be provided to accommodate a variety of submersion depths.

With tool tip 16 disposed in proximity to workpiece 22, transducer 12 (FIG. 1) produces ultrasonic vibration that axially propagates down horn 14 (FIG. 1) and causes axial vibration V1 along longitudinal axis LA (FIG. 1) at tool tip 16. In some embodiments, a portion of the axial vibration V1 can be converted into torsional vibration V2 via features provided on the tool or horn 14. The axial vibration V1 and torsional vibration V2 cause abrasive particles 38 between tool tip 16 and machining surface 44 to abrade workpiece 22 and thereby locally remove material from workpiece 22 as shown in FIG. 2. As material is removed, tool tip 16 can be advanced further toward workpiece 22 along longitudinal axis LA to form a deeper hole in workpiece 22, and/or can be translated along a surface of workpiece 22 to produce a slot or other feature along a surface of workpiece 22. Tool tip 16 can be advanced further into abrasive slurry 34 as material is removed from machining surface 44 and tool tip 16 is advanced along longitudinal axis LA. In some embodiments, UIG machine 24 can be configured to move tool tip 16 along each of the x-, y-, and z-axis. UIG machine 24 can also be configured to rotate tool tip 16 about any one or more of the x, y-, and z-axis. For example, UIG machine 24 can be configured to machine a plurality of holes in workpiece 22 disposed at varying angles. In other examples, UIG machine 24 can be configured to rotate tool tip 16 (e.g., in drilling motion).

Actuating platform 32 can be configured to rotate vessel 26 and thereby workpiece 22 about the z-axis. In some embodiments, actuating platform 32 can be configured to rotate vessel 26 and thereby workpiece 22 about the x- and/or y-axis to tilt workpiece 22 (as illustrated by arrows 46 and 48). As previously described, wall(s) 41 of vessel 26 can be designed to accommodate tilting of vessel 26 without spilling abrasive slurry 34. Vessel 26 can be tilted to expose additional machining surfaces 44 of workpiece 22 to tool tip 16 while keeping the additional machining surfaces 44 submerged in abrasive slurry 34. In some embodiments, actuating platform 32 can be configured to translate workpiece 22 within the x-y plane and/or along the z-axis to position machining surface 44 in proximity to tool tip 16.

One or more mixing mechanisms 36 can be provided in vessel 26 to agitate abrasive slurry 34 and keep abrasive particles 38 in suspension, deliver new abrasive particles 38 to machining surface 44, and to displace removed workpiece material from machining surface 44. Without one or more mixing mechanisms 36, abrasive particles 38 will settle via gravity to the bottom of vessel 26 and, thereby, reduce the amount of abrasive particles 38 present between tool tip 16 and machining surface 44 available for machining workpiece 22.

Mixing mechanism 36 can be, for example, a pump having an inlet and outlet disposed in vessel 26 configured to agitate abrasive slurry 34 through constant or intermittent circulation of abrasive slurry 34. Abrasive slurry 34, including used abrasive particles 38 and material removed from workpiece 22 can be drawn through the pump to cause circulation of abrasive slurry 34 at machining surface 44 and, thereby, replacement of used abrasive particles 38 with new abrasive particles 38.

In other embodiments, mixing mechanism 36 can be an ultrasonic transducer configured to agitate or mix abrasive slurry 34 via ultrasonic vibration. Mixing mechanism 36 can be, for example, an ultrasonic probe disposed in abrasive slurry 34 and separated from tool tip 16 and workpiece 22 so as not to interfere with machining operation or to cause abrasive particles 38 to impact workpiece 22 with sufficient force to cause microchipping.

In yet other embodiments, mixing mechanism 36 can be a mechanical agitator or stirring device. In yet other embodiments, mixing mechanism 36 can be any combination of one or more mechanical mixing mechanisms. It will be understood by one of ordinary skill in the art that mixing mechanism 36 can be any suitable device or combination of devices suitable for maintaining abrasive particles 38 in suspension and, particularly, between tool tip 16 and machining surface 44, and to continuously replace used abrasive particles 38 and removed workpiece material between tool tip 16 and machining surface 44 with new abrasive particles 38.

Mixing mechanism 36 can be affixed to vessel 26 to maintain a position of mixing mechanism 36 in vessel 26 or can be affixed to a body outside of vessel 26 such that mixing mechanism 36 can be moved as needed with actuation of actuating platform 32 and/or actuation of tool tip 16.

Abrasive slurry 34 can become loaded with material removed from workpiece 22 during UIG operation. The loading of abrasive slurry 34 can be monitored throughout one or more UIG operations. Once a loading limit is reached, rendering the abrasive slurry 34 ineffective or inefficient for UIG operation, abrasive slurry 34 along with material removed from one or more workpieces 22 can be removed from vessel 26. Abrasive slurry 34 can be recycled by removing the workpiece material via filtering.

Figure 3:
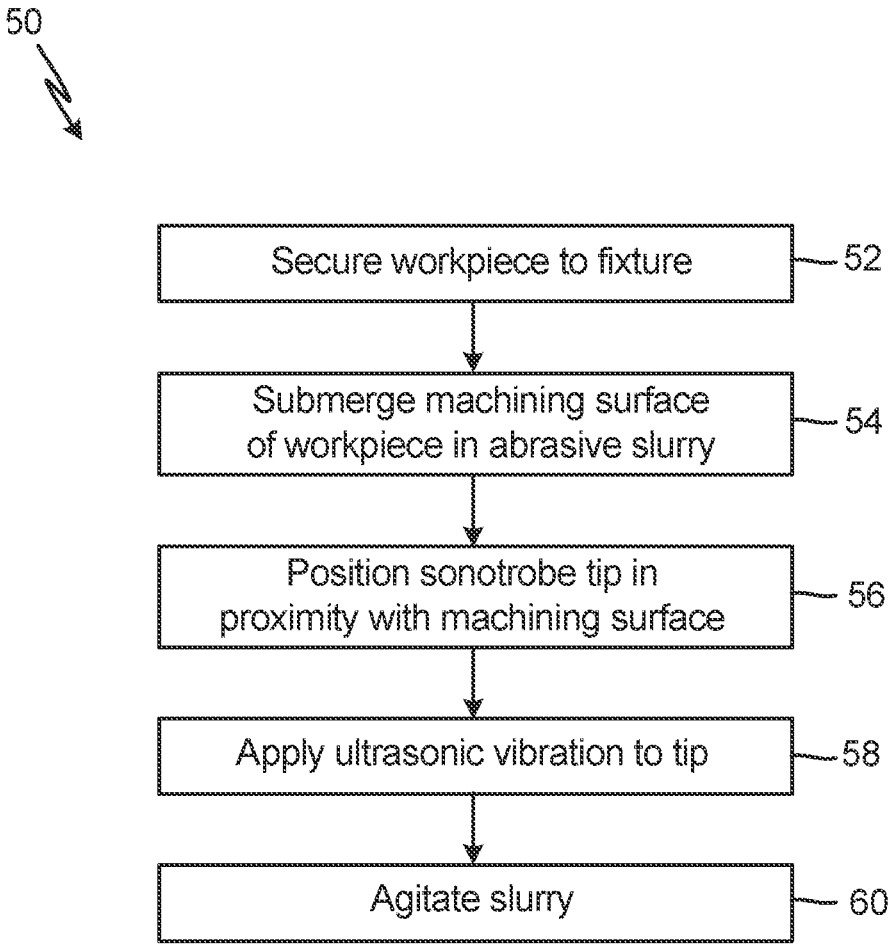
FIG. 3 is a flow chart of a method for machining workpiece using the UIG assembly of FIG. 1.

FIG. 3 is a flow chart of method 50 for machining ceramic workpiece 22 using UIG assembly 20. Method 50 can include one or more steps not shown.

In step 52, workpiece 22 is secured to fixture 28 in vessel 26. Fixture 28 can include a plurality of retention elements including, but not limited to cylindrical dowel pins, rectangular pads, and clamps. As previously described, workpiece 22 can be secured to a plurality of cylindrical dowel pins and/or pads to prevent movement of workpiece 22 in all directions relative to vessel 26. Workpiece 22 can be secured to fixture 28 to allow workpiece 22 to move with vessel 26 with six degrees of freedom (e.g., workpiece 22 can be rotated and/or tilted with vessel 26).

Protective layer 30 is applied to surfaces of fixture 28 configured to contact workpiece 22. As previously described, protective layer 30 is a sacrificial layer or replaceable layer configured to absorb vibrational energy transmitted through workpiece 22 to protect fixture 28 from wear by workpiece 22, and to prevent abrasive particles 38 from damaging workpiece 22 and fixture 28 at the workpiece/fixture interface. Protective layer 30 is applied to fixture 28 before workpiece 22 is secured to fixture 28. Protective layer 30 can be replaced as needed between UIG operations following removal of workpiece 22.

In step 54, one or more machining surfaces 44 of workpiece 22 is submerged in abrasive slurry 34. Depending on the shape and/or size of workpiece 22 and the location of one or more desired machining surfaces 44, all or a subset of workpiece 22 can be submerged in abrasive slurry 34. Workpiece 22 can be arranged on fixture 28 to locate one or more machining surfaces 44 near the surface of abrasive slurry 34 to limit a submersion depth of tool tip 16 in abrasive slurry 34. Preferably, a depth of abrasive slurry 34 above machining surface 44 can be greater than ⅛ inch (0.318 cm) or greater than ¼ inch (0.635 cm)

In step 56, tool tip 16 is positioned in proximity with machining surface 44 of workpiece 22 and in contact with abrasive slurry 34. As previously described, tool tip 16 can be arranged in any orientation relative to machining surface 44 accommodated by vessel 26 and UIG machine 24. For example, tool tip 16 can be oriented 20-30 degrees relative to machining surface 44 to form cooling holes in a component.

In step 58, ultrasonic vibration is applied via transducer 12 and horn 14 to tool tip 16. Ultrasonic vibration causes abrasive particles 38 in abrasive slurry 34 to impact machining surface 44 and abrade workpiece 22. Abrasive particles 38 are driven to penetrate into the exposed working surface 44 and remove microchips of workpiece material. A combination of axial and torsional ultrasonic vibration can cut and smooth machining surface 44. As ultrasonic vibration is applied, tool tip 16 can be advanced along longitudinal axis LA and/or translated along the x- and/or y-axis to form features (e.g., slot) in a surface of workpiece 22. In some embodiments, vessel 26 can be rotated or tilted to move workpiece 22 relative to tool tip 16 during application of ultrasonic vibration.

In step 60, abrasive slurry 34 is agitated with mixing mechanism 36. Step 60 can occur simultaneously with step 58 to ensure abrasive particles 38 are provided between machining surface 44 and tool tip 16. As previously described, mixing mechanism can include one or more devices configured to agitate or mix abrasive slurry to keep abrasive particles 38 in suspension, to replenish abrasive slurry 34 between machining surface 44 and tool tip 16 with new abrasive particles 38, and to displace material removed from workpiece 22. In one embodiment, agitating abrasive slurry 34 includes drawing abrasive slurry 34 through a pump having an inlet and outlet disposed in vessel 26. In one embodiment, agitating abrasive slurry 34 can include applying ultrasonic vibrational energy to abrasive slurry 34 in vessel 26 at a location separated from tool tip 16 and machining surface 44. In some embodiments, one or more of the same or different mixing mechanisms 36 can be used to agitate or mix abrasive slurry 34 to ensure efficient UIG operation.

Vessel 26 can be rotated about one or more of the x-, y-, and z-axis to tilt workpiece 22 and/or turn workpiece 22 relative to tool tip 16 to position one or more new machining surfaces 44 in proximity to tool tip 16. Alternatively, or additionally, tool tip 16 can be moved with 5 degrees of freedom (i.e., up and down on z-axis, left and right, forward and back, and rotated about both x- and y-axes) to position tool tip 16 in proximity to the new machining surface 44.

Figure 4:
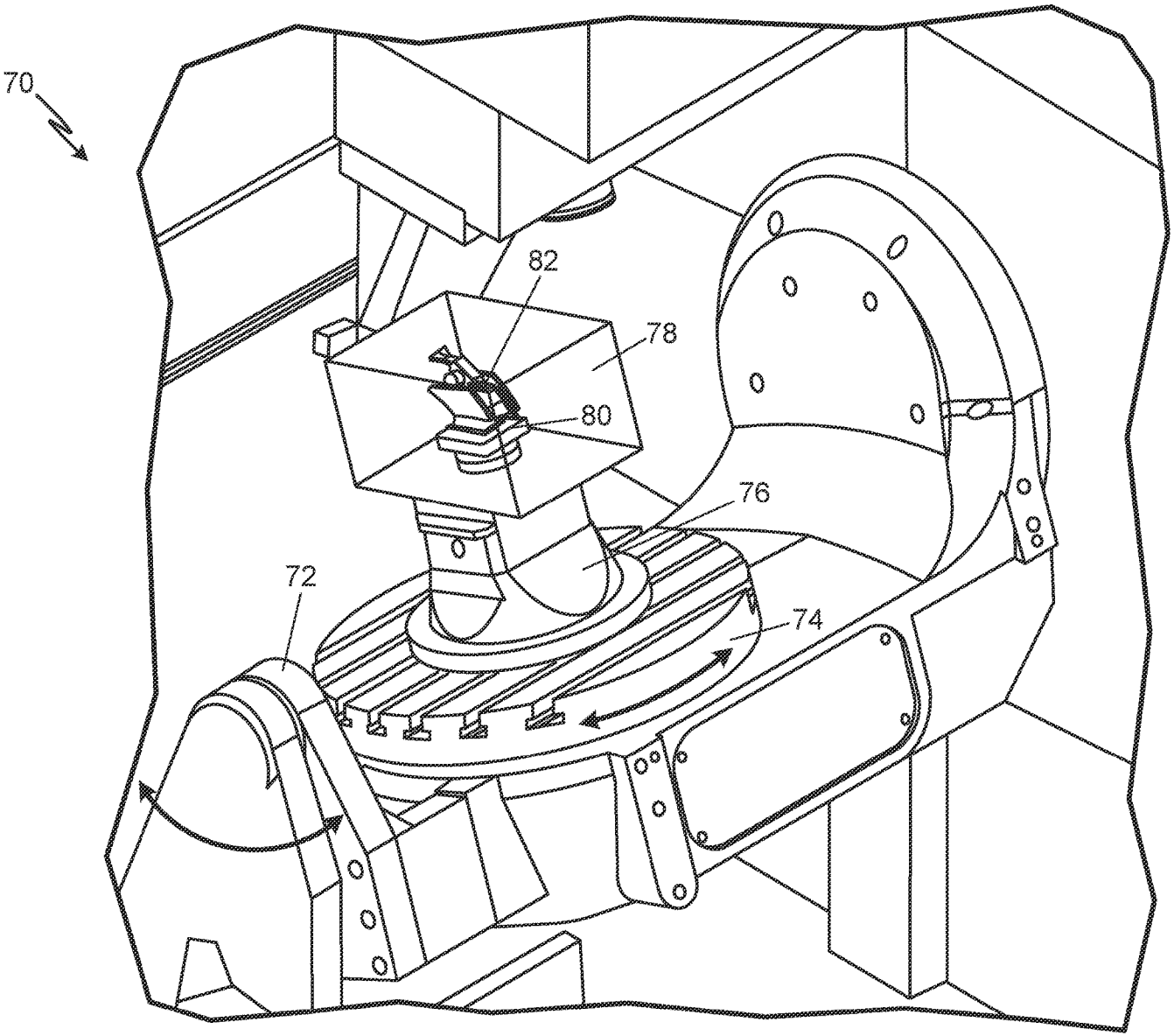
FIG. 4 is a perspective view of one example of an actuating platform for UIG assembly.

FIG. 4 is a perspective view of one example of an actuating platform for UIG assembly 20. FIG. 4 shows actuating platform 70, swinging portion 72, rotating portion 74, connecting member 76, vessel 78, fixture 80, and workpiece 82. Actuating platform 70 includes swinging portion 72 and rotating portion 74. Vessel 78 is supported by connecting member 76. Connecting member 76 attaches vessel 78 to rotating portion 74 of actuating platform 70. Workpiece 82 is disposed in vessel 78. Workpiece 82 is secured to vessel 78 by fixture 80. Fixture 80 is attached to an interior wall of vessel 78.

As previously described with respect to actuating platform 32 of FIG. 2, actuating platform 70 is configured to rotate and tilt vessel 78 and thereby workpiece 82. Swinging portion 72 is configured to swing or pivot about a fixed pin to tilt vessel 78 as shown in FIG. 4. Rotating portion 74 is configured to rotate or turn vessel 78 about the z-axis. As previously described, walls of vessel 78 can be designed to accommodate tilting of vessel 78 without spilling abrasive slurry. Vessel 78 can be tilted to expose additional machining surfaces of workpiece 82 to a tool tip (not shown) while keeping the additional machining surfaces submerged in the abrasive slurry.

The disclosed UIG operation can be simultaneously performed on multiple workpieces 22 disposed in vessel 26 to improve throughput. Use of the abrasive slurry bath provides continuous flow of abrasive particles 38 between machining surface 44 and tool tip 16 regardless of the orientation of tool tip 16 and workpiece 22.

The embodiments disclosed herein are intended to provide an explanation of the present invention and not a limitation of the invention. The present invention is not limited to the embodiments disclosed. It will be understood by one skilled in the art that various modifications and variations can be made to the invention without departing from the scope and spirit of the invention.

Although a combination of features is shown in the illustrated examples, not all features need to be combined to realize the benefits of various embodiments of this disclosure. For example, in some embodiments, actuating platform 28 can be a stationary platform or can be configured to only rotate about the z-axis (i.e., not tilt). A system designed according to an embodiment of this disclosure, therefore, will not necessarily include all of the features shown in the illustrated examples.

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure. Moreover, any relative terms or terms of degree used herein should be interpreted to encompass a range that expressly includes the designated quality, characteristic, parameter or value, without variation, as if no qualifying relative term or term of degree were utilized in the given disclosure or recitation.

DISCUSSION OF POSSIBLE EMBODIMENTS

The following are non-exclusive descriptions of possible embodiments of the present invention.

An ultrasonic impact grinding assembly includes a vessel configured to contain an abrasive slurry, at least one mixing mechanism disposed in the vessel, the at least one mixing mechanism configured to agitate the abrasive slurry, a fixture disposed on a base of the vessel, and an ultrasonic impact grinding machine having a tool tip disposed to contact the abrasive slurry in the vessel during an ultrasonic grinding operation. The vessel is open at a top. The fixture is configured to retain a workpiece for ultrasonic impact grinding within the abrasive slurry.

The ultrasonic impact grinding assembly of the preceding paragraph can optionally include, additionally and/or alternatively, any one or more of the following features, configurations and/or additional components:

An embodiment of the ultrasonic impact grinding assembly of the preceding paragraph can further include a protective layer disposed on surfaces of the fixture configured to contact the workpiece.

In an embodiment of the ultrasonic impact grinding assembly of any of the preceding paragraphs, the protective layer can include a polymer.

An embodiment of the ultrasonic impact grinding assembly of any of the preceding paragraphs can further include an actuating platform connected to the vessel and configured to rotate the vessel about at least one of an x-, y-, and z-axis to tilt the vessel and/or turn the vessel.

In an embodiment of the ultrasonic impact grinding assembly of any of the preceding paragraphs, the ultrasonic impact grinding machine can be configured to operate with six degrees of freedom.

In an embodiment of the ultrasonic impact grinding assembly of any of the preceding paragraphs, the vessel has a depth sufficient to contain the abrasive slurry when a machining surface of the workpiece is submerged in the abrasive slurry.

In an embodiment of the ultrasonic impact grinding assembly of any of the preceding paragraphs, the abrasive slurry can include a plurality of abrasive particles suspended in an aqueous solution and wherein the at least one mixing mechanism is configured to provide agitation sufficient to maintain a concentration of the abrasive particles between a machining surface of the workpiece and a tip of the ultrasonic impact grinding machine during ultrasonic impact grinding operation.

In an embodiment of the ultrasonic impact grinding assembly of any of the preceding paragraphs, the at least one mixing mechanism can be a pump having an inlet and an outlet disposed in the vessel.

In an embodiment of the ultrasonic impact grinding assembly of any of the preceding paragraphs, the at least one mixing mechanism can agitate the abrasive slurry by ultrasonic vibration.

In an embodiment of the ultrasonic impact grinding assembly of any of the preceding paragraphs, the vessel can be configured to contain a plurality of workpieces with machining surfaces submerged in the abrasive slurry.

A method for machining a ceramic workpiece includes submerging a machining surface of the ceramic workpiece in an abrasive slurry, positioning a tip of an ultrasonic impact grinding machine in proximity with the machining surface and into contact with the abrasive slurry, applying ultrasonic vibration to the tip, and agitating the abrasive slurry with a mixing mechanism disposed in the abrasive slurry.

The method of the preceding paragraph can optionally include, additionally and/or alternatively, any one or more of the following features, configurations, additional components, and/or steps:

In an embodiment of the method of the preceding paragraph, agitating the abrasive slurry can include drawing the abrasive slurry through a pump having an inlet and an outlet disposed in a vessel containing the ceramic workpiece.

In an embodiment of the method of any of the preceding paragraphs, agitating the abrasive slurry can include applying ultrasonic vibrational energy to the abrasive slurry in a vessel containing the ceramic workpiece, wherein the mixing mechanism providing the ultrasonic vibrational energy to agitate the abrasive slurry is separate from the ultrasonic impact grinding machine.

An embodiment of the method of any of the preceding paragraphs can further include securing the ceramic workpiece to a fixture disposed in a vessel containing the abrasive slurry.

An embodiment of the method of any of the preceding paragraphs can further include providing a protective layer between the ceramic workpiece and the fixture, wherein the protective layer seals a contact interface of the ceramic workpiece and fixture from incursion of abrasive particles in the abrasive slurry.

An embodiment of the method of any of the preceding paragraphs can further include rotating a vessel containing the abrasive slurry and the ceramic workpiece about at least one of an x-, y-, and z-axis to tilt and/or turn the ceramic workpiece to position a new machining surface in proximity to the tip, wherein the new machining surface is submerged in the abrasive slurry.

An embodiment of the method of any of the preceding paragraphs can further include moving the tip with five degrees of freedom into proximity with a new machining surface of the ceramic workpiece, wherein the new machining surface is submerged in the abrasive slurry.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An ultrasonic impact grinding assembly comprising:

a vessel configured to contain an abrasive slurry, the vessel having an open top disposed opposite a base;

at least one mixing mechanism disposed in the vessel, the at least one mixing mechanism configured to agitate the abrasive slurry to maintain abrasive particles in suspension;

a fixture disposed on the base, the fixture configured to retain a workpiece for ultrasonic impact grinding within the abrasive slurry;

an ultrasonic impact grinding machine having a tool tip disposed to contact the abrasive slurry in the vessel during an ultrasonic impact grinding operation to remove material from the workpiece, the tool tip having a shape configured to form a hole or slot in a machining surface of the workpiece via ultrasonic impact grinding, wherein the ultrasonic impact grinding machine is configured to move the tool tip relative to the workpiece to increase a depth or size of the hole or slot; and an actuating platform connected to the vessel configured to rotate the vessel about at least two different axes to tilt and turn the vessel and workpiece relative to the tool tip.

2. The ultrasonic impact grinding assembly of claim 1, and further comprising a protective layer disposed on surfaces of the fixture configured to contact the workpiece.

3. The ultrasonic impact grinding assembly of claim 2, wherein the protective layer comprises a polymer.

4. The ultrasonic impact grinding assembly of claim 1, wherein the ultrasonic impact grinding machine is configured to operate with six degrees of freedom.

5. The ultrasonic impact grinding assembly of claim 1, wherein the vessel has a depth sufficient to contain the abrasive slurry when a machining surface of the workpiece is submerged in the abrasive slurry.

6. The ultrasonic impact grinding assembly of claim 1, wherein the abrasive slurry comprises a plurality of abrasive particles suspended in an aqueous solution and wherein the at least one mixing mechanism is configured to provide agitation sufficient to maintain a concentration of the abrasive particles between a machining surface of the workpiece and the tool tip of the ultrasonic impact grinding machine during ultrasonic impact grinding operation.

7. The ultrasonic impact grinding assembly of claim 6, wherein the at least one mixing mechanism is a pump having an inlet and an outlet disposed in the vessel.

8. The ultrasonic impact grinding assembly of claim 6, wherein the at least one mixing mechanism comprises an ultrasonic transducer disposed in the abrasive slurry and separated from the tool tip, vessel, and workpiece, the ultrasonic transducer configured to agitate the abrasive slurry by ultrasonic vibration.

9. The ultrasonic impact grinding assembly of claim 1, wherein the vessel is configured to contain a plurality of workpieces with machining surfaces submerged in the abrasive slurry.

10. A method for machining a ceramic workpiece, the method comprising:

submerging a first machining surface of the ceramic workpiece in an abrasive slurry contained in a vessel having an open top;

fixing the ceramic workpiece to a base of the vessel;

positioning a tip of an ultrasonic impact grinding machine in proximity with the first machining surface and into contact with the abrasive slurry;

applying ultrasonic vibration to the tip to remove material from the first machining surface of the ceramic workpiece to form a feature in the ceramic workpiece of a desired geometry;

agitating the abrasive slurry with a mixing mechanism disposed in the abrasive slurry to maintain abrasive particles in suspension;

advancing the tip into the ceramic workpiece or along the ceramic workpiece to increase a depth or size of feature of desired geometry formed in the ceramic workpiece via ultrasonic impact grinding;

moving the tip and/or the ceramic workpiece to position the tip in proximity with a second machining surface submerged in the abrasive slurry; and rotating the vessel about at least two different axes to tilt and turn the vessel and ceramic workpiece relative to the tip.

11. The method of claim 10, wherein agitating the abrasive slurry comprises drawing the abrasive slurry through a pump having an inlet and an outlet disposed in a vessel containing the ceramic workpiece.

12. The method of claim 10, wherein agitating the abrasive slurry comprises applying ultrasonic vibrational energy to the abrasive slurry in the vessel containing the ceramic workpiece via an ultrasonic transducer disposed in the abrasive slurry and separated from the ultrasonic impact grinding machine, the vessel, and the ceramic workpiece.

13. The method of claim 10, wherein fixing the ceramic workpiece comprises securing the ceramic workpiece to a fixture disposed in the vessel containing the abrasive slurry.

14. The method of claim 13, and further comprising providing a protective layer between the ceramic workpiece and the fixture, wherein the protective layer seals a contact interface of the ceramic workpiece and fixture from incursion of abrasive particles in the abrasive slurry.

15. The method of claim 14, wherein the rotating of the vessel about the at least two different axes positions the second machining surface in proximity to the tip.

16. The method of claim 14, and further comprising moving the tip with five degrees of freedom into proximity with the second machining surface of the ceramic workpiece.

17. The method of claim 10, wherein the feature of desired geometry is a hole or a slot.

* * * * *